US008863849B2

(12) United States Patent
Patel

(10) Patent No.: US 8,863,849 B2
(45) Date of Patent: Oct. 21, 2014

(54) ELECTRIC SUBMERSIBLE PUMPING COMPLETION FLOW DIVERTER SYSTEM

(75) Inventor: Dinesh Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/345,280

(22) Filed: Jan. 6, 2012

(65) Prior Publication Data

US 2012/0181043 A1 Jul. 19, 2012

Related U.S. Application Data

(60) Provisional application No. 61/432,982, filed on Jan. 14, 2011.

(51) Int. Cl.
*E21B 34/06* (2006.01)
*E21B 43/12* (2006.01)

(52) U.S. Cl.
CPC ..... *E21B 34/06* (2013.01); *E21B 43/128* (2013.01)
USPC ..... 166/373; 166/319; 166/332.1; 166/332.4

(58) Field of Classification Search
USPC ..... 166/373, 381, 319, 325, 332.1, 332.4, 166/332.8, 237
See application file for complete search history.

(56) References Cited

U.S. PATENT DOCUMENTS

| | | | | |
|---|---|---|---|---|
| 4,429,740 A | | 2/1984 | Malinchak | |
| 4,440,231 A | * | 4/1984 | Martin | 166/373 |
| 4,658,857 A | * | 4/1987 | Ayres, Jr. | 137/601.11 |
| 6,302,216 B1 | * | 10/2001 | Patel | 166/375 |
| 7,665,529 B2 | * | 2/2010 | Farquhar et al. | 166/374 |
| 2009/0032264 A1 | * | 2/2009 | Shepler | 166/370 |

FOREIGN PATENT DOCUMENTS

| | | |
|---|---|---|
| GB | 2411416 A | 8/2005 |
| GB | 2419924 A | 5/2006 |
| GB | 2431677 A | 5/2007 |
| WO | 0043634 A2 | 7/2000 |
| WO | 2007026142 A1 | 3/2007 |

OTHER PUBLICATIONS

Search Report issued in GB1200347.1 on Mar. 13, 2013, 2 pages.

* cited by examiner

*Primary Examiner* — Cathleen Hutchins
*Assistant Examiner* — Taras P Bemko
(74) *Attorney, Agent, or Firm* — David J. Groesbeck; Brandon S. Clark

(57) ABSTRACT

A technique provides a system and methodology for enhancing the operational life of an electric submersible pumping system. A completion is combined with a flow diverter valve and is positioned downhole in a wellbore. An electric submersible pumping system is coupled into the completion and the flow diverter valve is oriented to control fluid flow with respect to the electric submersible pumping system. For example, the flow diverter valve may be automatically operable to direct well fluid to the electric submersible pumping system when the pumping system is operating and to direct well fluid to bypass the electric submersible pumping system when the pumping system is not operating.

20 Claims, 11 Drawing Sheets

ELECTRIC SUBMERSIBLE PUMPING COMPLETION FLOW DIVERTER SYSTEM

CROSS-REFERENCE TO RELATED APPLICATION

The present document is based on and claims priority to U.S. Provisional Application Ser. No. 61/432,982, filed Jan. 14, 2011, incorporated herein by reference.

BACKGROUND

Hydrocarbon fluids such as oil and natural gas are obtained from a subterranean geologic formation, referred to as reservoir, by drilling a well that penetrates the hydrocarbon-bearing formation. Once a wellbore is drilled, various forms of well completion components may be installed to control and enhance the efficiency of producing various fluids from the reservoir. One piece of equipment which may be installed is an electronic submersible pump (ESP). Typically, ESPs have a limited run-life, and as such, must be changed out multiple times throughout the life of the well. The change out requires significant time and cost in preparing the well for a rig to perform the change out operation.

SUMMARY

In general, the present disclosure provides a system and method for enhancing the operational life of an electric submersible pumping system. A completion is combined with a flow diverter valve and is positioned downhole in a wellbore. An electric submersible pumping system is coupled into the completion and the flow diverter valve is oriented to control fluid flow with respect to the electric submersible pumping system. For example, the flow diverter valve may be automatically operable to direct well fluid to the electric submersible pumping system when the pumping system is operating and to direct well fluid to bypass the electric submersible pumping system when the pumping system is not operating.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology of utilizing well completion systems. The technique is designed to extend the working life of an electric submersible pump (ESP) installed as part of the completion. Some embodiments of the present disclosure relate to an ESP completion in a subsea well. In this type of system, ESP life often is limited according to the mechanical nature of the pump. As a result, periodic workover operations are performed to retrieve the ESP for servicing and this requires substantial time and expense. However, the present design utilizes a flow diverter valve which diverts the flow of fluid in the well to bypass the ESP when ESP is not running and further directs the flow of fluid to the ESP when the ESP is in operation. Use of the flow diverter valve in this manner increases the life of the ESP because the ESP is seeing fluid flow only when operating.

In some embodiments, a barrier valve also may be employed to provide a mechanical barrier to the formation. The mechanical barrier provides well control which facilitates safe retrieval of the electric submersible pumping system without requiring killing of the well. Additionally, the flow diverter valve may be an automated valve which automatically switches the fluid flow between modes of bypassing the electric submersible pumping system or directing the fluid flow to an intake of the electric submersible pumping system. By way of examples, the flow diverter valve may comprise one-way flow restrictors and/or an automatically shiftable mandrel.

Figure 1:
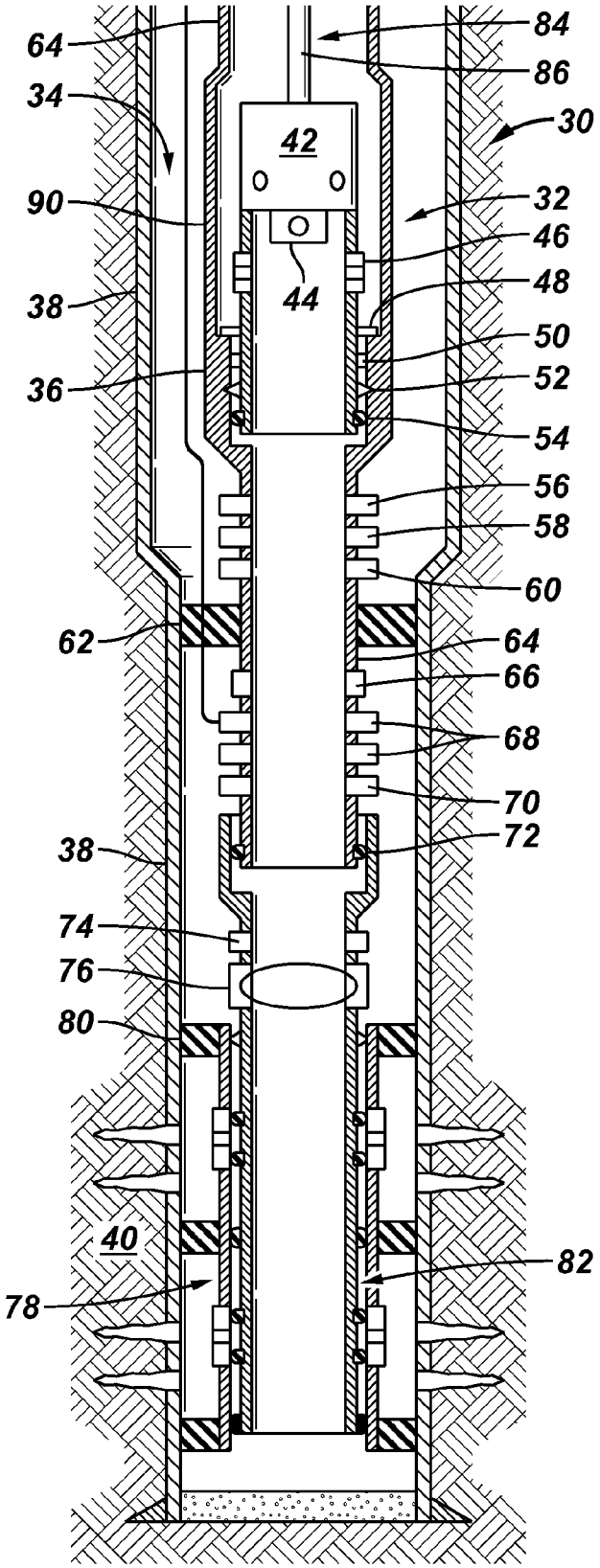
FIG. 1 is a schematic illustration of an example of an electric submersible pumping completion system, according to an embodiment of the disclosure.

Referring generally to FIG. 1, an example of one type of application utilizing a flow diverter valve in a downhole completion to extend the life of an electric submersible pumping system is illustrated. The example is provided to facilitate explanation, and it should be understood that a variety of well completion systems and other well or non-well related systems may utilize the methodology described herein. The flow diverter valve may be located at a variety of positions and may be constructed in various configurations depending on the operational and environmental characteristics of a given production application.

In FIG. 1, an embodiment of a well system 30 is illustrated as comprising a well completion 32 deployed in a wellbore 34. The completion 32 may be part of a tubing string or tubular structure 36 and may include a variety of components, depending in part on the specific application, geological characteristics, and well type. In the example illustrated, wellbore 34 is substantially vertical and lined with a casing 38. However, various types of well completions 32 may be used in a well system having other types of wellbores, including deviated, e.g. horizontal, single bore, multilateral, cased, and uncased (open bore) wellbores. In the example illustrated, wellbore 34 extends down into a subterranean formation 40 having at least one production zone from which hydrocarbon-based fluids are produced.

An electric submersible pumping system 42 comprising an intake 44 may be conveyed into engagement with completion 32 and may be considered part of the completion once engaged. Depending on the particular application, the completion 32 may comprise a wide variety of components and systems to facilitate the production operation. The embodiment illustrated in FIG. 1 is provided as an example and illustrates one type of embodiment that may be used for a specific production application. However, the number, type, arrangement, and presence of the completion components may be changed to accommodate different types of production applications.

In the example of FIG. 1, completion 32 comprises a flow diverter valve 46 positioned between the electric submersible pumping system 42 and the remainder of completion 32. The flow diverter valve 46 may comprise an automatic flow diverter valve which automatically bypasses the electric submersible pumping system 42 when the electric submersible pumping system 42 is not operating and which automatically directs fluid flow to intake 44 of electric submersible pumping system 42 when the pumping system is operating. The completion 32 also may comprise a variety of other components positioned, for example, below flow diverter valve 46. By way of example, completion 32 may comprise a debris protector 48, an anti-torque lock 50, a latch 52, and a polished bore receptacle and seal assembly 54.

In the example illustrated, completion 32 also may comprise numerous other components, such as the illustrated lubricator valve 56, a circulating valve 58, and a surface controlled subsurface safety valve 60. Beneath valves 56, 58 and 60, completion 32 may comprise a production packer 62 surrounding a production tubing 64 having a hollow interior to provide a flow passage. Beneath production packer 62, completion 32 may comprise a variety of additional components, such as a rupture disk sub 66, a chemical injection mandrel 68, and a pressure/temperature gauge mandrel 70.

An upper portion of the completion 32 engages a lower portion of the completion 32 via a lower polished bore receptacle and seal assembly 72 which extends down toward a nipple 74 positioned above a formation isolation valve 76 having, for example, a dual trip saver or a single trip saver. In this example, the lower polished bore receptacle and seal assembly 72 engages a fracturing assembly 78, e.g. a frac pack assembly, suspended beneath an upper GP packer 80. The fracturing assembly 78 further comprises a production isolation seal assembly 82 which is used to isolate fracturing sleeves. It should be noted, however, that completion 32 may have many different types of forms and configurations which may utilize a variety of the illustrated components and/or other components as desired for a specific application. Similarly, the electric submersible pumping system 42 may comprise a variety of components (e.g. submersible pump, motor protector, motor, intake 44, and other components as desired for the application). The electric submersible pumping system 42 may be conveyed into engagement with completion 32 to become part of completion 32 via a suitable conveyance 84, e.g. coiled tubing, including or combined with a suitable cable 86, e.g. power cable.

Figure 2:
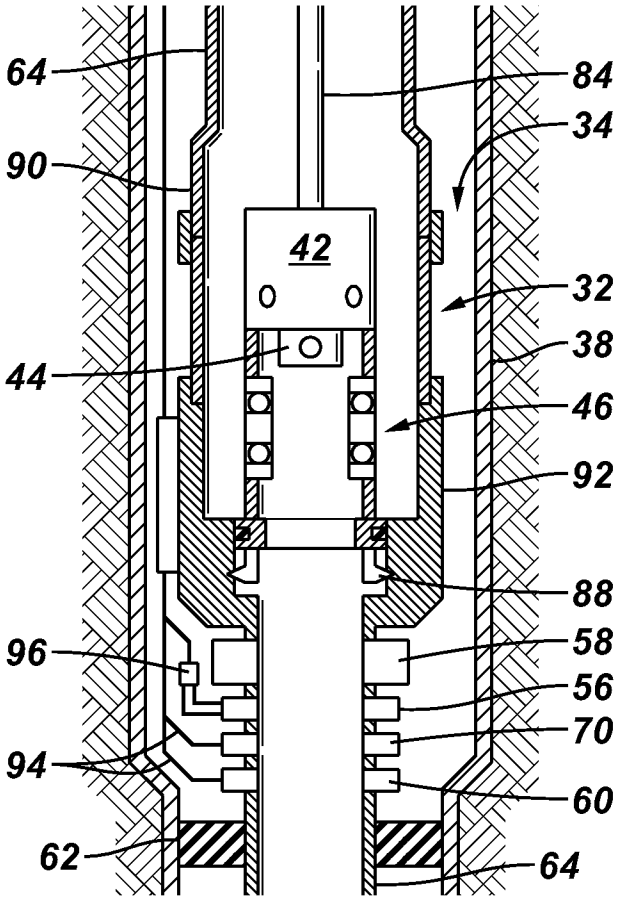
FIG. 2 is a schematic illustration of a flow diverter valve employed in the electric submersible pumping completion system, according to an embodiment of the disclosure.
Figure 5:
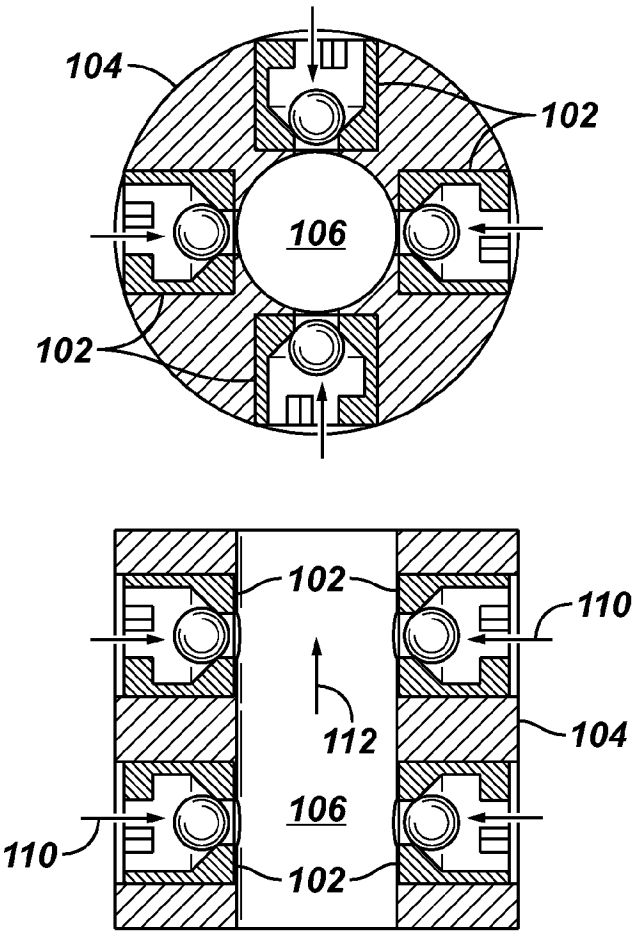
FIG. 5 is a schematic illustration of the automatic flow diverter valve illustrated in FIG. 4 but in a different operational position, according to an embodiment of the disclosure.

Referring generally to FIG. 2, a schematic example of a well system 30 is illustrated in which the flow diverter valve 46 is coupled between the electric submersible pumping system 42 and a snap latch assembly 88. Snap latch assembly 88 is designed to engage completion 32 when the electric submersible pumping system 46 is conveyed downhole. In this example, electric submersible pumping system 42, flow diverter valve 46, and snap latch assembly 88 are conveyed down into a flow shroud 90 and into a coupling shroud 92 designed to receive and engage snap latch assembly 88. A variety of control lines 94 and line switches 96 may be employed to transmit signals, e.g. control signals, to or from the various valves and gauges for a given completion configuration.

Figure 3:
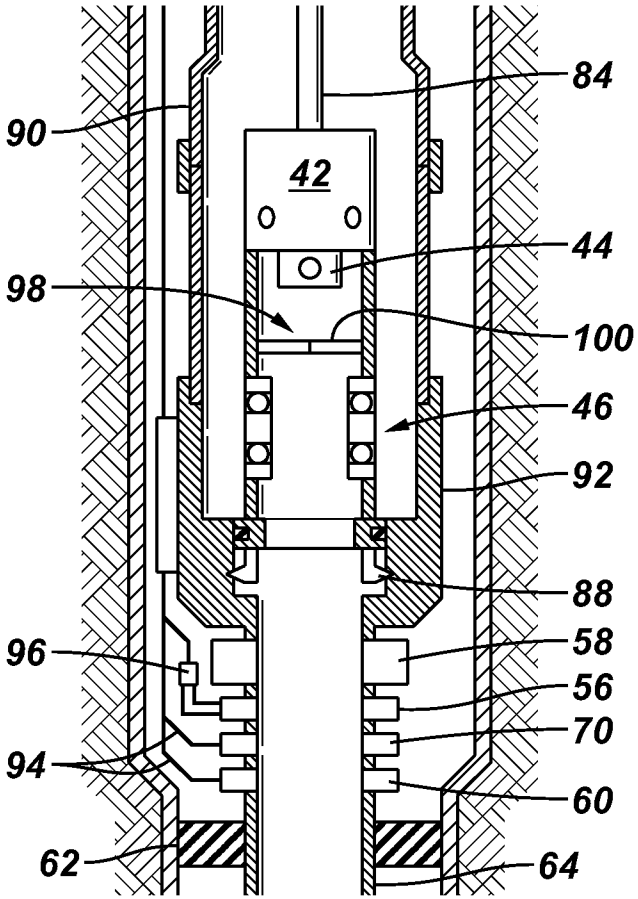
FIG. 3 is a schematic illustration of another embodiment of the electric submersible pumping completion system, according to an embodiment of the disclosure.

In some applications, an additional valve/restrictor 98 is placed between flow diverter valve 46 and electric submersible pumping system 42, as illustrated in FIG. 3. By way of example, the valve/restrictor 98 may be in the form of a segmented flapper 100 having a plurality of flapper elements which open during operation of electric submersible pumping system 42 to enable flow to intake 44.

Figure 4:
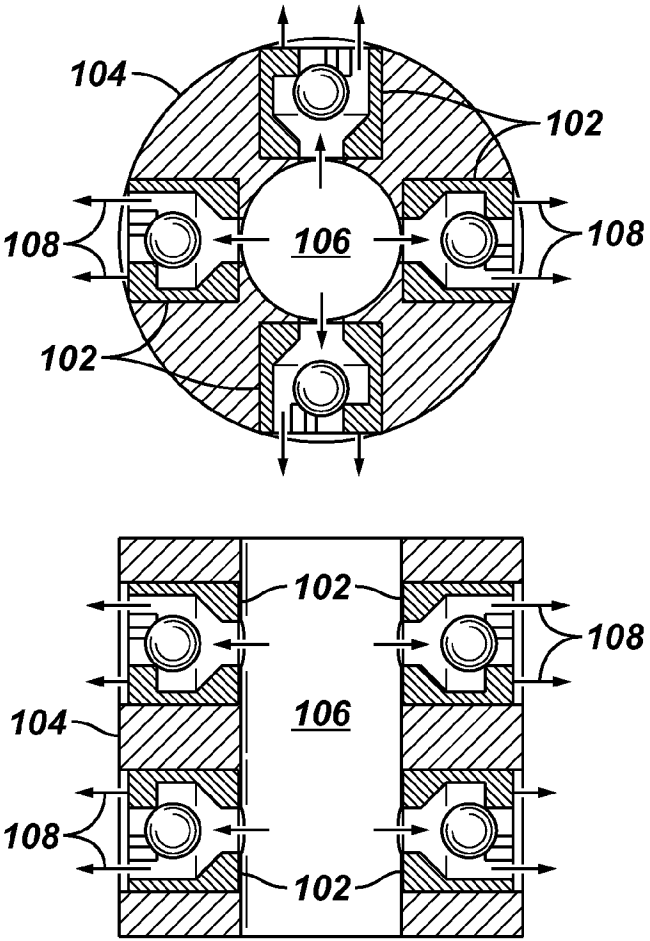
FIG. 4 is a schematic illustration of an example of an automatic flow diverter valve, according to an embodiment of the disclosure.
Figure 6:
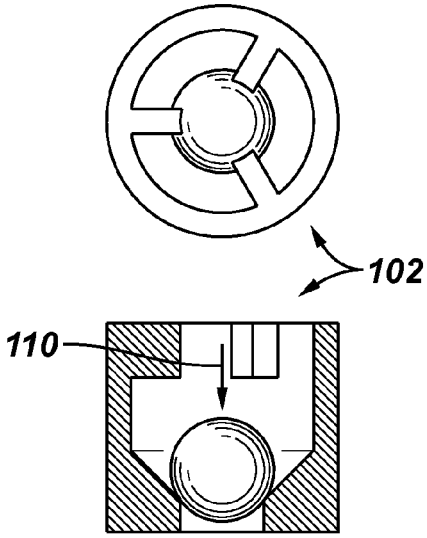
FIG. 6 is a schematic illustration of a one-way flow restrictor which may be used in the flow diverter valve, according to an embodiment of the disclosure.
Figure 7:
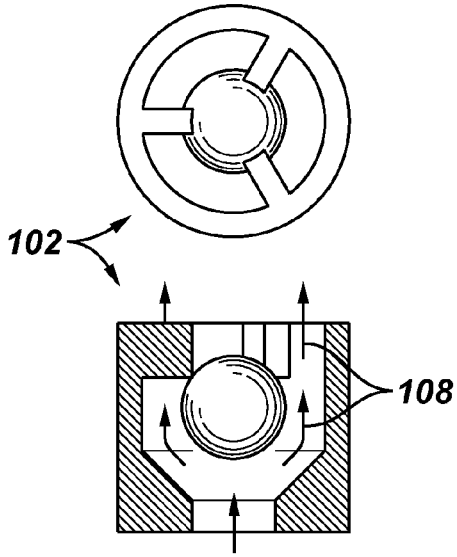
FIG. 7 is a schematic illustration similar to that of FIG. 6 but showing the one-way flow restrictor in a different operational position, according to an embodiment of the disclosure.

An example on an automated flow diverter valve 46 is illustrated in FIGS. 4-7. In this example, the automated flow diverter valve 46 comprises a one-way flow restrictor 102 located in the flow diverter valve to automatically direct fluid flow to or past electric submersible pumping system 42. In the specific example illustrated, the automated flow diverter valve 46 comprises a plurality of the one-way flow restrictors 102. The one-way flow restrictors 102 may comprise a floating ball, a floating plate, a flapper, or any other suitable structure that allows flow in one direction but restricts flow in an opposite direction. Additionally, the one-way flow restrictors 102 may be located in a sidewall 104 of flow diverter valve 46 to control flow between an exterior and an interior flow passage 106. As illustrated in FIGS. 4 and 7, when the electric submersible pumping system 42 is stopped, i.e. not operating, fluid flows in one direction from interior flow passage 106 through sidewall 104 to an exterior of the flow diverter valve 46, as indicated by arrows 108, thus bypassing electric submersible pumping system 42. However, when electric submersible pumping system 42 is turned on and operated, fluid drawn into intake 44 automatically shifts the one-way flow restrictors 102, as indicated by arrows 110 in FIGS. 5 and 6. In this example, the electric submersible pumping system outlet pressure is higher than the intake pressure when the electric submersible pumping system is running; this differential pressure automatically shifts the one-way flow restrictors 102 to a closed position thus directing flow to the electric submersible pumping system. The automatic transition of one-way flow restrictors 102 stops flow from the exterior of the flow diverter valve 46 to interior flow passage 106, and flow is directed on to intake 44 of electric submersible pumping system 42 as illustrated by arrows 112 in FIG. 5.

Figure 8:
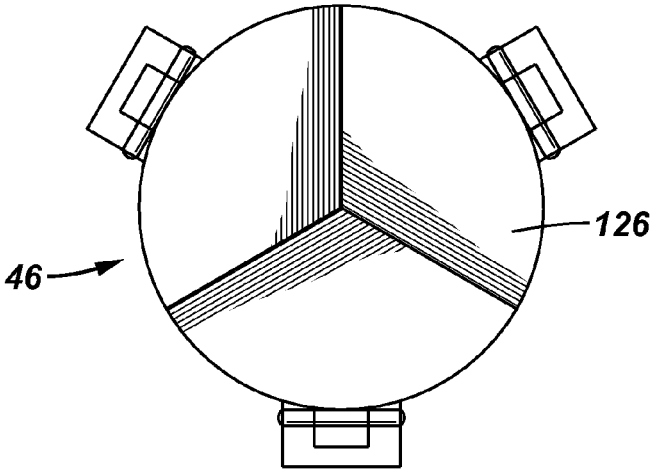
FIG. 8 is a schematic top view of another example of an automatic flow diverter valve, according to an embodiment of the disclosure.
Figure 10:
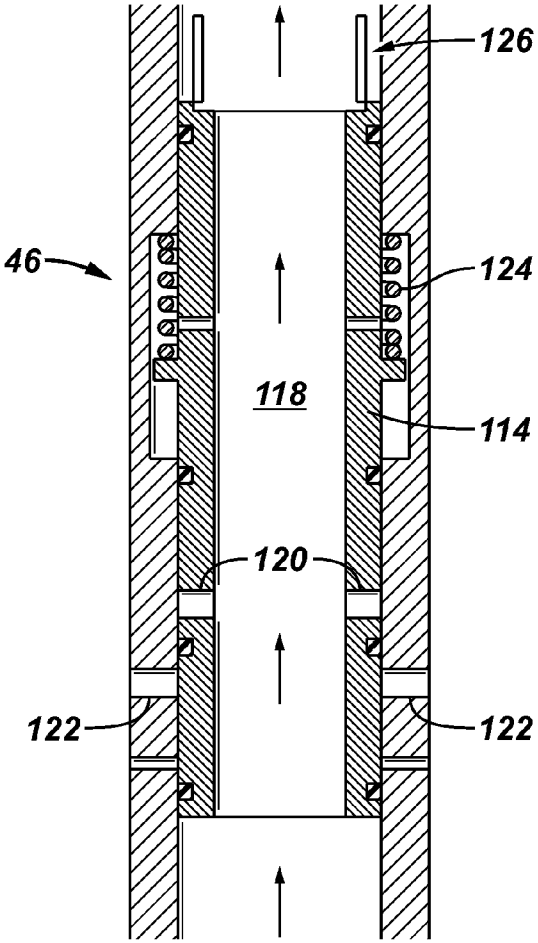
FIG. 10 is a schematic illustration similar to that of FIG. 9 but showing the automatic flow diverter valve in a different operational configuration, according to an embodiment of the disclosure.
Figure 9:
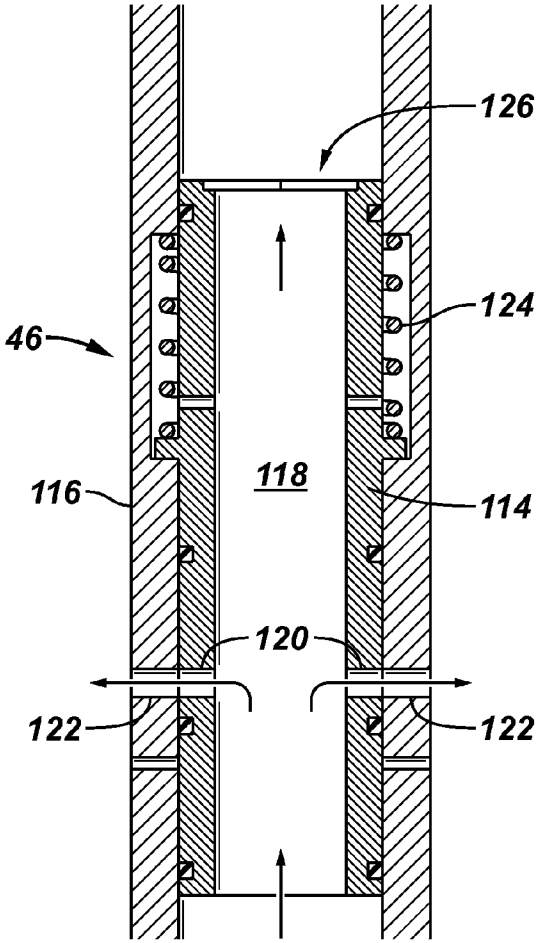
FIG. 9 is a schematic cross-sectional view of the automatic flow diverter valve illustrated in FIG. 8, according to an embodiment of the disclosure.

Referring generally to FIGS. 8-10, another embodiment flow diverter valve 46 is illustrated as an automatic flow diverter valve 46 which automatically transitions when electric submersible pumping system 42 is operated or shut off, as described above. In this example, the flow diverter valve 46 comprises a mandrel 114 slidably mounted in a surrounding housing 116. The mandrel 114 comprises an internal, longitudinal flow passage 118 and at least one radial flow passage 120 which may be moved into and out of the engagement with a corresponding radial flow passage 122 through the surrounding housing 116. In the example illustrated, mandrel 114 is spring biased via a spring member 124 toward a position which aligns radial flow passages 120 and 122, as illustrated in FIG. 9. In some embodiments, the flow diverter valve 46 also may comprise a valve 126, e.g. a segmented spring biased flapper valve, which remains closed until a certain pressure differential is created from below to above when the electric submersible pumping system 42 is turned on. The differential pressure from below pushes the mandrel 114 up against the spring member in a closed position, thus isolating the flow ports 122 in housing 116. Additional differential pressure from below (and after the mandrel 114 moves upwardly) opens the segmented flapper 126 and allows flow to intake 44 of the electric submersible pumping system 42, as illustrated in FIG. 10. In another embodiment, one-way flow restrictors 102 are installed in ports 122 of housing 116 to prevent flow from the outlet to the intake of the electric submersible pumping system 42. The flow restrictors 102 can be in the form of a floating ball, a floating plate, a flapper, or another suitable mechanism that allows flow only in one direction.

When electric submersible pumping system 42 is shut off, spring member 124 is able to move mandrel 114 into a position aligning radial flow passages 120 and 122 and closing valve member 126 to prevent flow along longitudinal flow passage 118 to intake 44. As a result, fluid flow along the wellbore is directed outwardly through radial flow passages 120, 122 so as to bypass electric submersible pumping system 42. Once the electric submersible pumping system 42 is turned on and operated, however, the intake flow and suction created by the electric submersible pumping system 42 draws mandrel 114 against spring member 124 and moves radial flow passages 120 out of alignment with radial flow passages 122. Operation of the electric submersible pumping system 42, and the subsequent increase in differential pressure following movement of mandrel 114, also opens valve 126 to enable flow of well fluid along longitudinal flow passage 118 to intake 44 of electric submersible pumping system 42.

Figure 12:
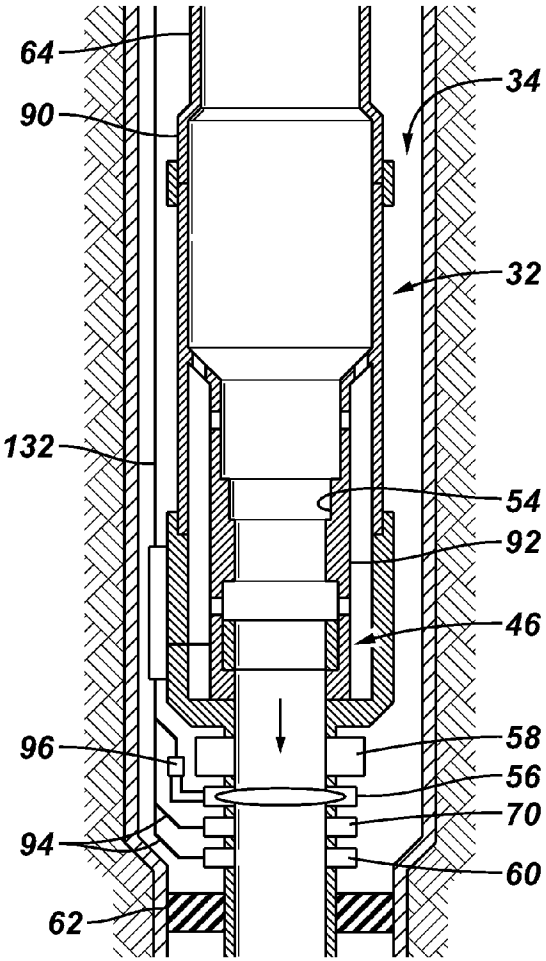
FIG. 12 is a schematic illustration similar to that of FIG. 11 with the completion packer set, according to an embodiment of the disclosure.
Figure 11:
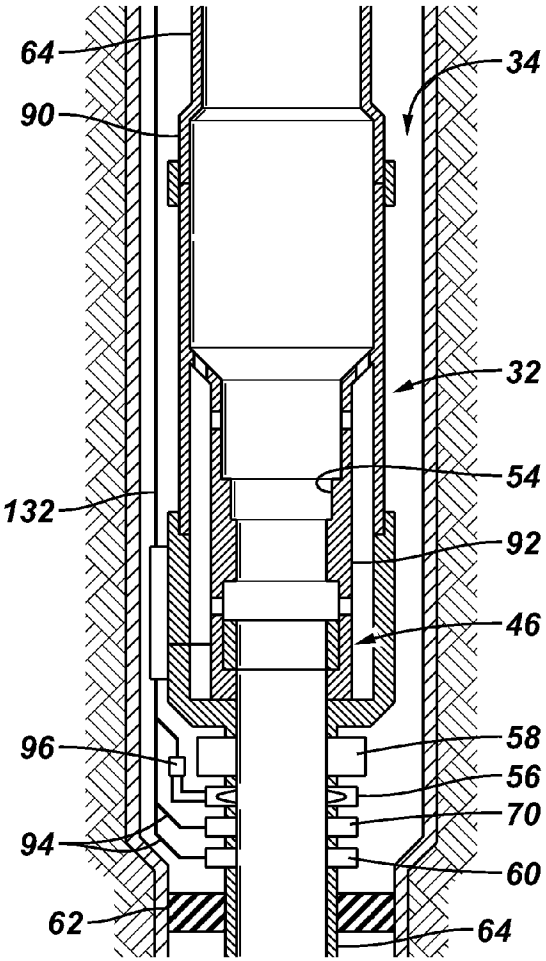
FIG. 11 is a schematic illustration of a completion run into a wellbore, according to an embodiment of the disclosure.
Figure 14:
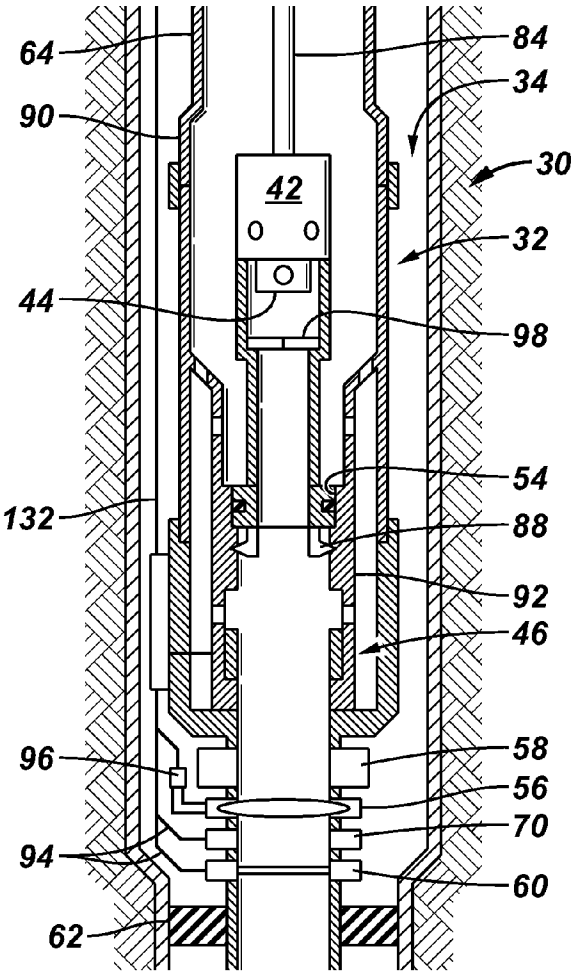
FIG. 14 is a schematic illustration similar to that of FIG. 13 but with the electric submersible pumping system run into engagement with the completion, according to an embodiment of the disclosure.
Figure 13:
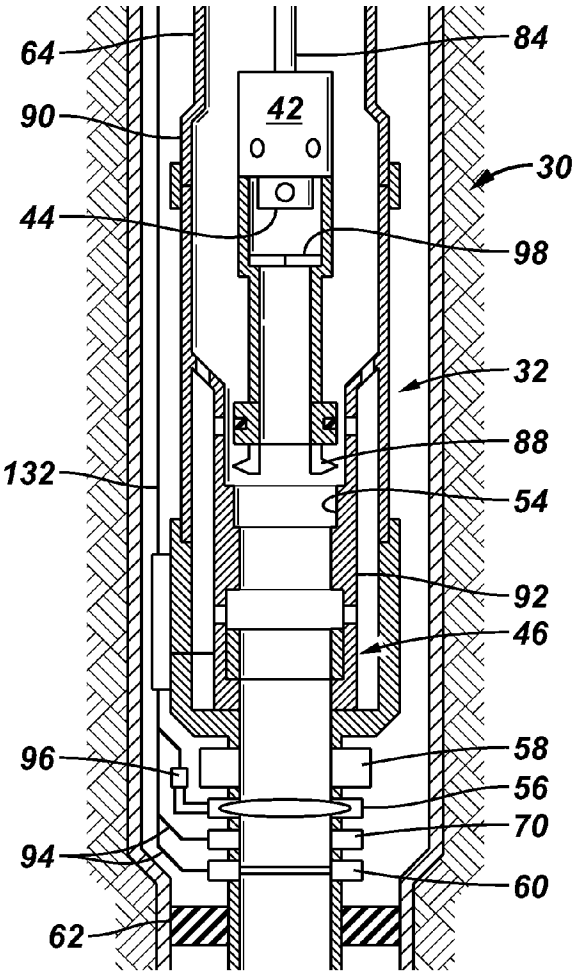
FIG. 13 is a schematic illustration similar to that of FIG. 12 but with the electric submersible pumping system being run into the wellbore, according to an embodiment of the disclosure.

In an operational example, completion 32 is initially run into the well without electric submersible pumping system 42, as illustrated in FIG. 11. In this embodiment, the completion 32 is run with flow diverter valve 46, e.g. a mandrel style flow diverter valve. At this stage, the circulating valve 58 is closed, the lubricator valve 56 is open, and the surface controlled subsurface safety valve 60 also is open. Once completion 32 is at a desired location within a wellbore 34, lubricator valve 56 is closed, tubing pressure is applied against the lubricator valve 56, and packer 62 is set via pressure applied through a packer control line as illustrated in FIG. 12. Subsequently, electric submersible pumping system 42 is run in hole with snap latch 88 and the valve/restrictor 98, as illustrated in FIG. 13. The electric submersible pumping system 42 is moved into engagement with completion 32 until snap latch 88 secures the electric submersible pumping system 42 by engaging and holding against coupling shroud 92, as illustrated in FIG. 14.

Figure 15:
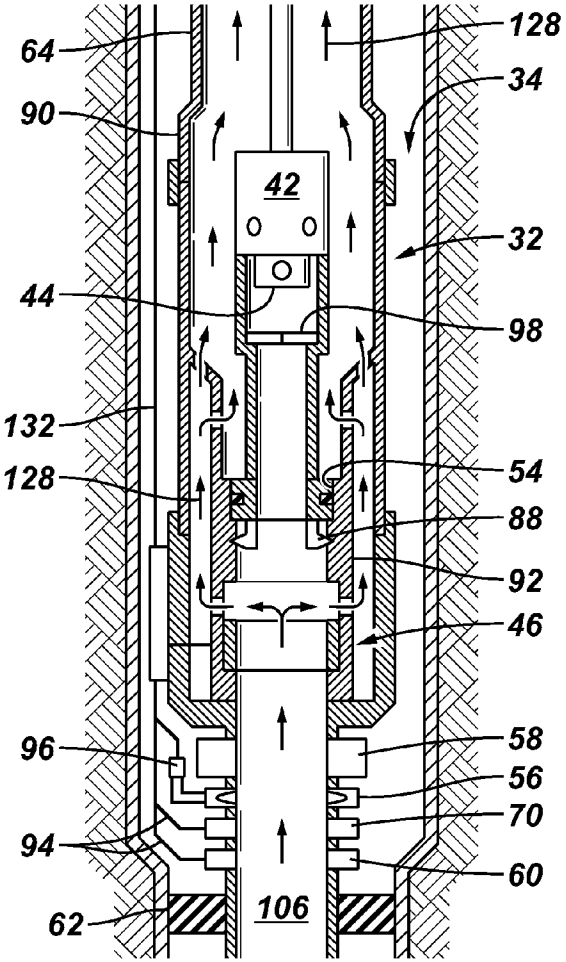
FIG. 15 is a schematic illustration similar to that of FIG. 14 but with the well naturally flowing and the flow diverter valve directing the fluid flow past the electric submersible pumping system, according to an embodiment of the disclosure.

After engagement of electric submersible pumping system 42 into completion 32, the electric submersible pumping system 42 may remain off to allow the well to be naturally flowed, as indicated by arrows 128 in FIG. 15. At this stage, the flow diverter valve 46 is in a failsafe open position which automatically diverts fluid flow from internal passage 106 and out to an exterior of the flow diverter valve 46 so as to bypass electric submersible pumping system 42 as illustrated.

Figure 16:
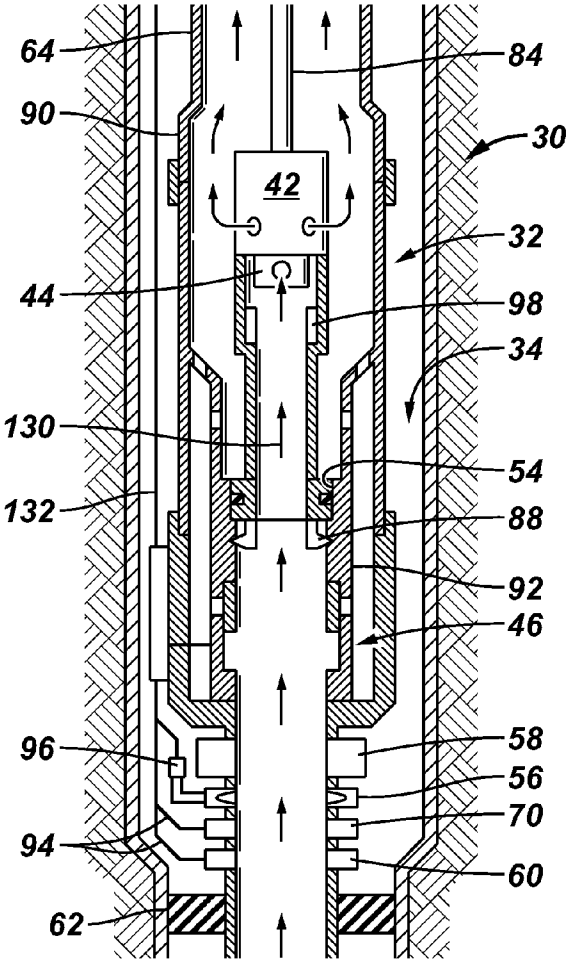
FIG. 16 is a schematic illustration similar to that of FIG. 14 but with the electric submersible pumping system operating and the flow diverter valve automatically redirecting flow to an intake of the electric submersible pumping system, according to an embodiment of the disclosure.

Once electric submersible pumping system 42 is started and operated, the flow diverter valve 46 may be automatically transitioned to close off flow from internal flow passage 106 to the exterior of the flow diverter valve 46, thus directing the flow to intake 44 of electric submersible pumping system 42, as illustrated in FIG. 16 by arrows 130. By way of example, the flow diverter valve 46 may comprise one-way flow restrictors 102 or mandrel 114, as described above, to enable automatic transition between operational modes upon starting or shutting off the electric submersible pumping system 42. It should be noted that in some embodiments, flow diverter valve 46 may be transitioned by providing an appropriate signal through a corresponding control line 132, e.g. a hydraulic control line, which may be used to transition the flow diverter valve 46 between operational states and/or to serve as a redundant feature for ensuring the desired transition.

Figure 17:
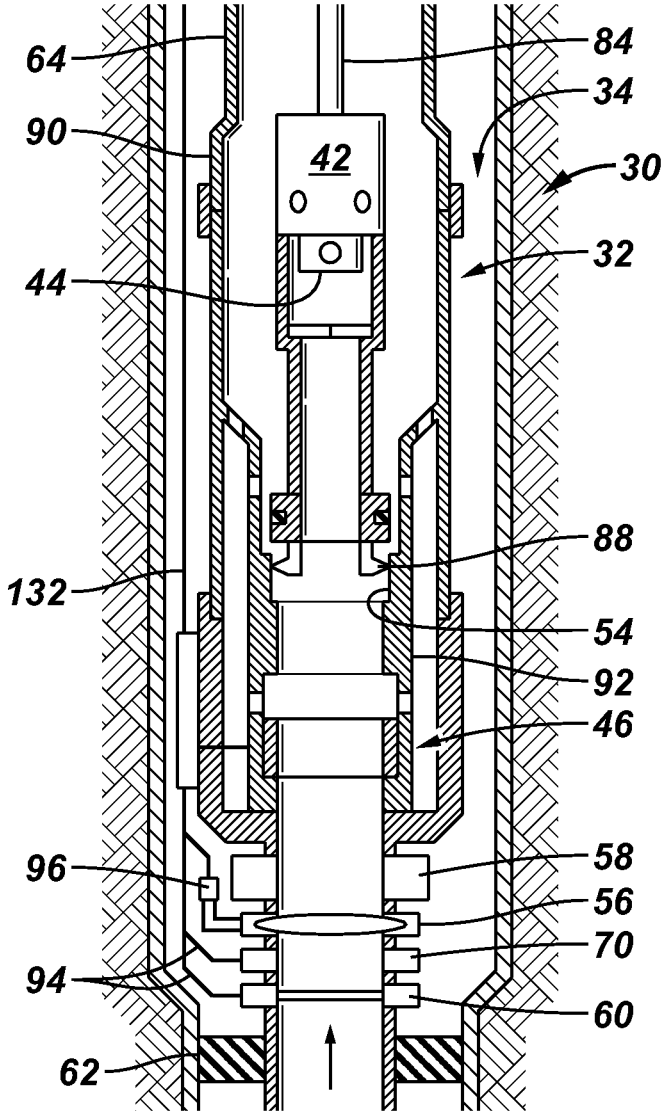
FIG. 17 is a schematic illustration similar to that of FIG. 14 but with the electric submersible pumping system being pulled out of hole, according to an embodiment of the disclosure.

If the electric submersible pumping system 42 is to be serviced or replaced, conveyance 84 may simply be pulled up to release snap latch 88, as illustrated in FIG. 17. Lubricator valve 56 and/or subsurface safety valve 60 may be closed to create a mechanical barrier with respect to the surrounding formation 40. A new or serviced electric submersible pumping system 42 may then be delivered downhole for engagement with the completion 32 as described previously.

Figure 19:
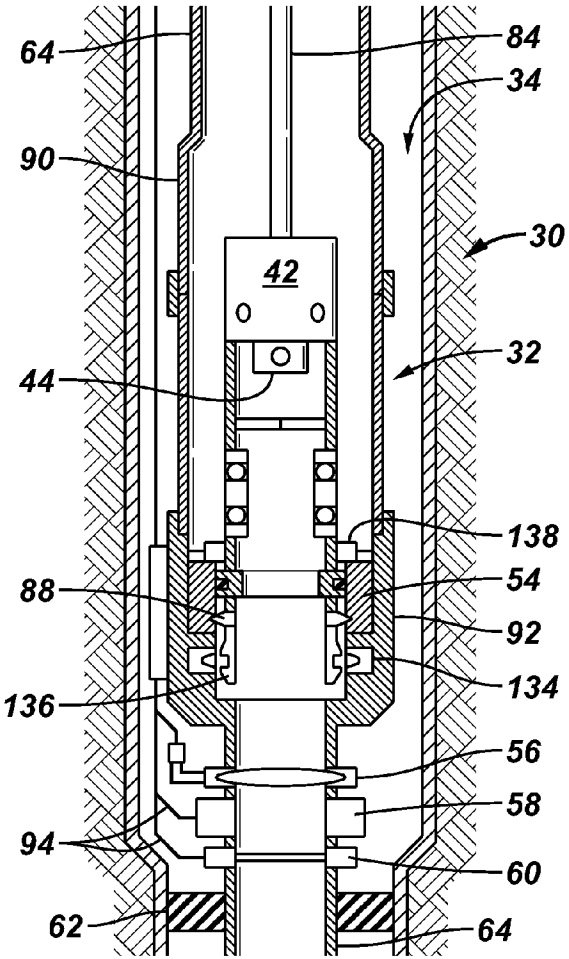
FIG. 19 is a schematic illustration similar to that of FIG. 18 but with the formation isolation valve in an open configuration, according to an embodiment of the disclosure.
Figure 18:
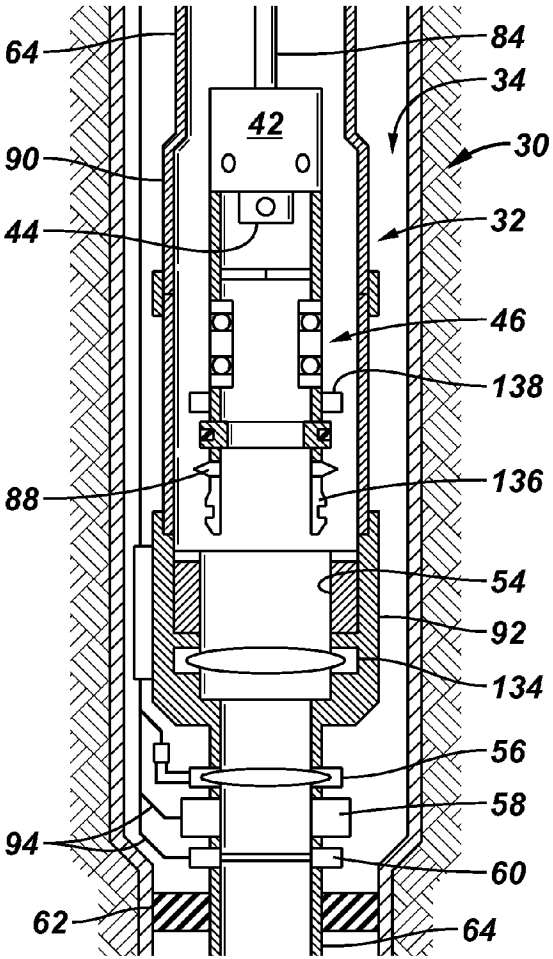
FIG. 18 is a schematic illustration an embodiment of the completion including a formation isolation valve in a closed configuration, according to an embodiment of the disclosure.
Figure 20:
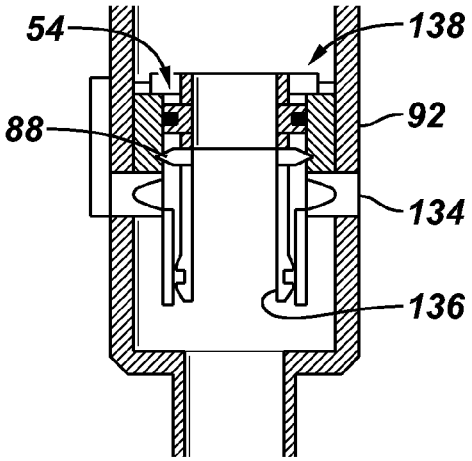
FIG. 20 is a schematic illustration similar to that of FIG. 19 showing the formation isolation valve in an open configuration, according to an embodiment of the disclosure.

Referring generally to FIGS. 18-20, another embodiment of completion 32 is illustrated. In this embodiment, completion 32 comprises a formation isolation valve 134. By way of example, the formation isolation valve 134 may be a mechanical formation isolation valve. As illustrated best in FIG. 18, this embodiment may combine a formation isolation valve shifting tool 136 with snap latch 88. The formation isolation valve shifting tool 136 and flow diverter valve 46 may be deployed downhole with electric submersible pumping system 42, as illustrated. In some embodiments, an anti-rotation mechanism 138 also may be deployed, at least in part, with the electric submersible pumping system 42 and the flow diverter valve 46.

As the electric submersible pumping system 42 is conveyed downhole into engagement with completion 32, formation isolation valve shifting tool 136 initially engages polished bore receptacle and then seal assembly 54. Continued movement causes formation isolation valve shifting tool 136 to shift the formation isolation valve 134 to an open configuration, as illustrated in FIGS. 19 and 20. Once fully engaged, rotation of the tool 136 and the electric submersible pumping system 42 with respect to the previously deployed completion 32 is prevented by anti-rotation mechanism 138.

Figure 21:
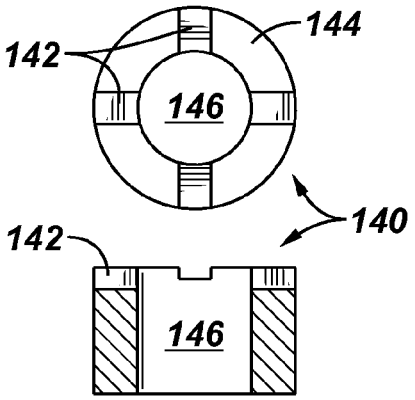
FIG. 21 is a schematic illustration of a portion of a rotational lock that may be mounted on the completion, according to an embodiment of the disclosure.
Figure 22:
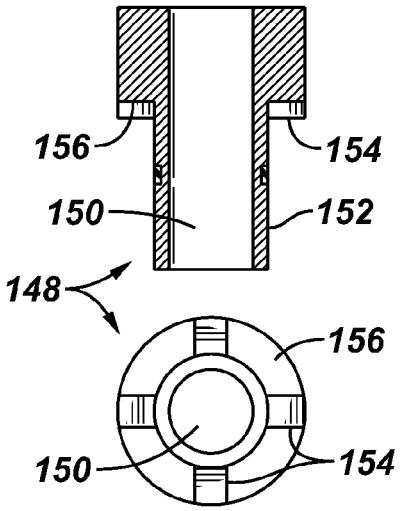
FIG. 22 is a schematic illustration of a portion of a rotational lock that may be mounted on the electric submersible pumping system, according to an embodiment of the disclosure.
Figure 23:
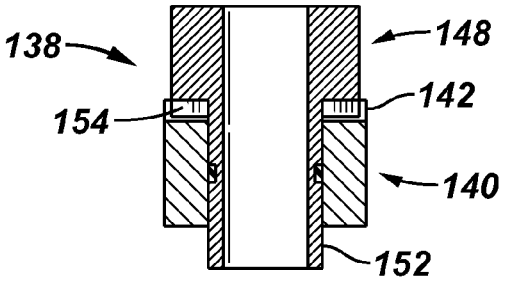
FIG. 23 is a schematic illustration of rotational lock portions illustrated in FIGS. 21 and 22 in an engaged position, according to an embodiment of the disclosure.

Referring generally to FIGS. 21-23, an example of anti-rotation mechanism 138 is illustrated. In this example, the anti-rotation mechanism 138 comprises a first engagement member 140 which is mounted on and deployed with completion 32 prior to conveyance of the electric submersible pumping system 42 downhole. The first engagement member 140 comprises a plurality of engagement features 142, e.g. slots, formed in an upper face 144 around a central passage 146, as best illustrated in FIG. 21.

In the embodiment illustrated, anti-rotation mechanism 138 also comprises a second engagement member 148 which may be mounted above the formation isolation valve shifting tool 136. The second engagement member 148 comprises a central passage 150 and a longitudinal extension 152 which may be sealingly received in central passage 146 of engagement member 140. The second engagement member 148 also comprises a plurality of corresponding engagement features 154, e.g. tangs, on a lower face 156 arranged around the longitudinal extension 152, as best illustrated in FIG. 22. When second engagement member 148 is moved into engagement with first engagement member 140, tangs 154 engage slots 142 to prevent relative rotation, as illustrated in FIG. 23.

Depending on the application, completion 32, flow diverter valve 46 and the electric submersible pumping system 42 may comprise a variety of components and may be arranged in several different types of configurations. In some applications, the flow diverter valve 46 initially may be deployed with completion 32 and in other applications the flow diverter valve 46 may be conveyed downhole with electric submersible pumping system 42. Accordingly, the flow diverter valve 46 may be connected into the completion 32 before, after, or simultaneously with connection of the electric submersible pumping system 42 into the completion 32. Additionally, various types of formation isolation valves, lubricator valves, and other features may be employed to create mechanical barriers with respect to the surrounding formation.

Furthermore, numerous types of additional and/or alternate components may be used with completion 32 and/or electric submersible pumping system 42 to perform a variety of functions downhole. For example, numerous types of sensors, packers, control valves, sand screens, control lines, power sources, completion segments, shifting tools, sliding sleeves, and other components may be utilized to achieve desired functions or to provide capabilities for specific applications and environments. Depending on the number and arrangement of components, completion 32 also may be deployed downhole in multiple independent completion segments.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of enhancing the operational life of a pumping system, comprising:

connecting a flow diverter valve into a completion, the flow diverter valve having a longitudinal internal passage forming a portion of a throughbore of the completion, wherein the flow diverter valve is operable between a closed position blocking radial fluid flow between the internal passage and exterior of the flow diverter valve and the completion and an open position permitting radial fluid flow in the direction from the internal passage to the exterior;

positioning the completion downhole in a wellbore;

coupling an electric submersible pumping system into the completion such that an intake is positioned in the completion throughbore and an outlet is in communication with the exterior;

operating the flow diverter valve to the closed position when the electric submersible pumping system is operating thereby directing upward fluid flow in the direction from the completion throughbore through the internal passage and into the intake; and operating the flow diverter valve to the open position when the electric submersible system is not operating thereby directing the upward fluid flow in the direction from the completion throughbore and radially through the flow diverter valve to the exterior thereby bypassing the intake.

2. The method as recited in claim 1, further comprising providing a mechanical barrier to a surrounding formation to provide well control during retrieval of the electric submersible pumping system from the wellbore.

3. The method as recited in claim 1, wherein the flow diverter valve comprises one-way flow restrictors positioned in a sidewall of the flow diverter valve permitting one-way flow in the direction from the internal passage to the exterior.

4. The method as recited in claim 3, wherein the one-way flow restrictors block radial fluid flow from the internal passage to the exterior in response to pressure in the exterior being greater than pressure in the internal passage.

5. The method as recited in claim 1, further comprising opening a segmented flapper valve restrictor enabling the upward fluid flow through the internal passage to the intake when the electric submersible pumping system is operating; and closing the segmented flapper valve restrictor when the electric submersible pumping system is not operating thereby blocking the upward fluid flow from the internal passage to the intake.

6. The method as recited in claim 1, wherein the operating the flow diverter valve to the closed position comprises axially moving a mandrel in the flow diverter valve to cover radial flow ports to direct fluid flow to the intake of the electric submersible pumping system.

7. The method as recited in claim 1, further comprising providing a mandrel with a segmented flapper in the flow diverter valve.

8. The method as recited in claim 1, further comprising spring biasing a mandrel of the flow diverter valve to the open position.

9. The method as recited in claim 1, wherein coupling comprises coupling the electric submersible pumping system into the completion with a snap latch.

10. The method as recited in claim 1, further comprising placing a formation isolation valve in the completion; and maintaining the formation isolation valve in a closed state prior to coupling the electric submersible pumping system into the completion.

11. The method as recited in claim 1, further comprising placing a lubricator valve in the completion on an opposite side of the formation isolation valve from the electric submersible pumping system.

12. A system for use in a well, comprising:

a completion having a throughbore positioned downhole in a wellbore, the completion comprising a flow diverter valve having a longitudinal internal passage forming a portion of the completion throughbore;

the flow diverter valve operable between a closed position blocking radial fluid flow between the internal passage and an exterior of the flow diverter valve and the completion and an open position permitting radial fluid flow in the direction from the internal passage to the exterior;

an electric submersible pumping system coupled into the completion and having an intake positioned in the completion throughbore and an outlet communicating to the exterior;

wherein the flow diverter valve is operated to the closed position when the electric submersible pumping system is operating thereby directing upward fluid flow in the direction from the completion throughbore through the internal passage and into the intake; and wherein the flow diverter valve is operated to the open position when the electric submersible system is not operating thereby directing the upward fluid flow in the direction from the completion throughbore radially through the flow diverter valve to the exterior.

13. The system as recited in claim 12, wherein operation of the electric submersible pumping system causes axial movement of a mandrel to cover radial flow ports thereby blocking radial fluid flow between the internal passage and the exterior and opens a valve member enabling the upward fluid flow from the internal passage and into the intake, wherein the valve member is positioned between the intake and the radial flow ports.

14. The system as recited in claim 12, wherein the completion further comprises a formation isolation valve which remains closed prior to coupling the electric submersible pumping system into the completion.

15. The system as recited in claim 14, wherein the completion further comprises a lubricator valve on an opposite side of the flow diverter valve from the electric submersible pumping system.

16. The system as recited in claim 12, wherein the flow diverter valve comprises a plurality of one-way flow restrictors positioned in a sidewall of the flow diverter valve, wherein the plurality of one-way flow restrictors permit one-way fluid flow in a radial direction from the internal passage to the exterior.

17. The system of claim 12, wherein the flow diverter valve is operated to the open position in response to a pressure in the internal passage being greater than the pressure in the exterior to the flow diverter valve and the completion and the flow diverter valve is operated to the closed position in response to the pressure in the internal passage being less than the pressure in the exterior.

18. A method, comprising:

coupling a flow diverter valve into a completion, the flow diverter valve having a longitudinal internal passage forming a portion of a throughbore of the completion, wherein the flow diverter valve is operable between a closed position blocking radial fluid flow between the internal passage and an exterior of the flow diverter valve and the completion and an open position permitting radial fluid flow in the direction from the internal passage to the exterior;

running the completion downhole into a wellbore;

setting a packer of the completion;

conveying an electric submersible pumping system downhole into engagement with the completion such that an intake is positioned in the completion throughbore and an outlet is in communication with the exterior;

operating the flow diverter valve to the closed position when the electric submersible pumping system is operating thereby directing upward fluid flow in the direction from the completion throughbore through the internal passage and into the intake; and operating the flow diverter valve to the open position when the electric submersible system is not operating thereby directing the upward fluid flow in the direction from the completion throughbore radially through the flow diverter valve to the exterior thereby bypassing the intake.

19. The method of claim 18, wherein the flow diverter valve is operated to the open position when the pressure is greater in the internal passage than in the exterior.

20. The method of claim 18, wherein the operating the flow diverter valve comprises applying a hydraulic signal to the flow diverter valve via a control line.

* * * * *